United States Patent [19]

Brüder et al.

[11] Patent Number: 4,548,538

[45] Date of Patent: Oct. 22, 1985

[54] MOBILE APPARATUS FOR MIXING AND LOADING CONCRETE

[75] Inventors: Gerhard Brüder, Rastatt; Horst Pippinger, Karlsruhe, both of Fed. Rep. of Germany

[73] Assignee: Elba-Werk Maschinen-Gesellschaft mbH & Co., Ettingen, Fed. Rep. of Germany

[21] Appl. No.: 445,043

[22] Filed: Nov. 29, 1982

[30] Foreign Application Priority Data

Dec. 11, 1981 [DE] Fed. Rep. of Germany ..... 3149130
Sep. 8, 1982 [DE] Fed. Rep. of Germany ..... 3233292

[51] Int. Cl.[4] ..... B28C 9/04
[52] U.S. Cl. ..... 414/332; 366/30
[58] Field of Search ..... 198/313, 509, 632; 414/293, 332, 787, 919; 366/26, 30, 33, 36

[56] References Cited

U.S. PATENT DOCUMENTS

| | | | |
|---|---|---|---|
| 3,064,832 | 11/1962 | Heltzel | 414/332 |
| 3,379,420 | 4/1968 | Maier | 366/26 X |
| 4,075,711 | 2/1978 | Hall | 366/26 |
| 4,093,085 | 6/1978 | Hudelmaier et al. | 414/787 |
| 4,125,332 | 11/1978 | Schmednecht | 366/33 |
| 4,248,359 | 2/1981 | Brock | 414/919 X |
| 4,249,848 | 2/1981 | Griffin et al. | 414/332 |

FOREIGN PATENT DOCUMENTS

| | | |
|---|---|---|
| 3149130 | 12/1983 | Fed. Rep. of Germany . |
| 1372241 | 8/1964 | France . |
| 1382127 | 11/1964 | France . |
| 1388544 | 12/1964 | France . |
| 1297527 | 7/1967 | France . |
| 407847 | 9/1966 | Switzerland . |
| 590751 | 7/1947 | United Kingdom . |

*Primary Examiner*—Joseph E. Valenza
*Assistant Examiner*—Ken Muncy
*Attorney, Agent, or Firm*—Karl F. Ross; Herbert Dubno

[57] ABSTRACT

An apparatus for preparing bulk material and loading it into a truck comprises an elongated first frame having a lower end and adapted to stand via this end on the ground, a horizontal pivot at the lower end of the first frame, and an elongated second frame having a lower end pivoted at the pivot on the lower end of the first frame and an upper end. The frames are relatively pivotally displaceable between a transport position with the one of the frames lying substantially within the other frame and a use position with the two frames extending at an angle to each other and the upper end of the second frame spaced above the ground by a distance equal to the loading height of the truck. A rail extends between the ends of the second frame and a bucket is displaceable along the rail between the ends of the second frame. In addition a doser is provided at the lower end of the first frame for filling the bucket, when it is at the lower ends, with bulk material.

6 Claims, 18 Drawing Figures

8
9
1'

1
2
3
4
5
10
11
12
13
15
16
17
18
19
20
21
22
G
H

Fig.13
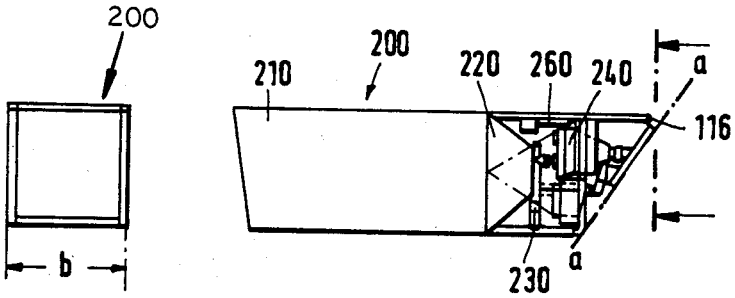
Fig.13A
Fig.14
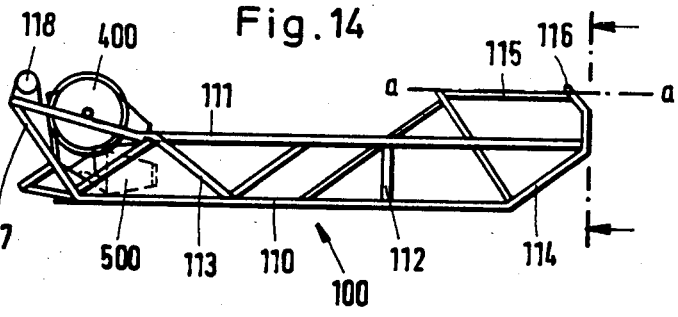
Fig.14A
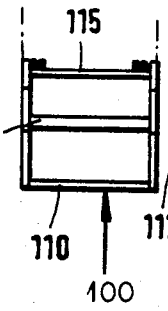
Fig.15
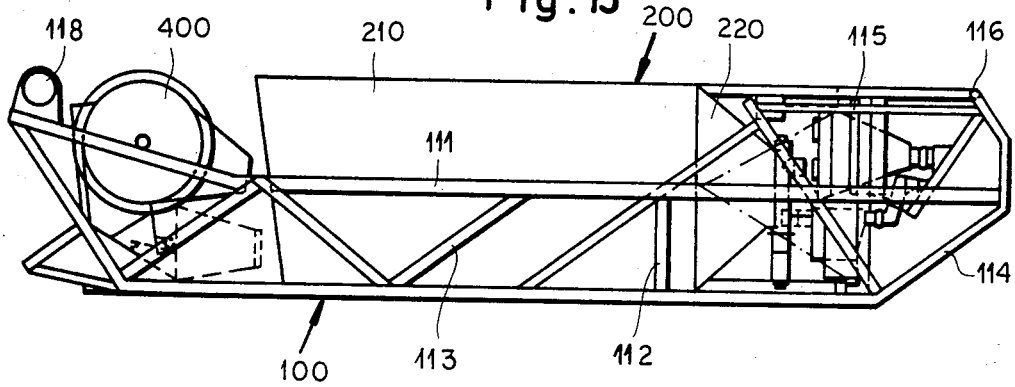

MOBILE APPARATUS FOR MIXING AND LOADING CONCRETE

FIELD OF THE INVENTION

The present invention relates to an apparatus for mixing concrete and loading it into a truck. More particularly this invention concerns such an apparatus which can be moved from site to site.

BACKGROUND OF THE INVENTION

It is standard practice in large civil-engineering projects to mix concrete at the site. The cement, water, and aggregates are stocked in bulk so they can be mixed together and loaded into standard mixer trucks which transport the mixture to the work location. This is, for instance, the procedure used on remote highway-construction projects. Such a procedure ensures that fresh concrete whose composition is closely controlled can be produced cheaply and delivered to the job without appreciable supply problems.

To this end a large mobile apparatus is used which usually comprises a tower that is transported to the site horizontally and erected, then fitted with various cranes, outrigger arms, and the like. The assembly must normally have devices for holding or amassing the various components of the concrete mixture, then lifting up this mixture to a level high enough, typically at least 4 meters, to load it into the cement truck.

Such an arrangement is usually very complex to set up. The assembly must normally be done by a special crew using a small crane, and even so quite some time is needed. Disassembly and preparation for transport to another site is normally also quite complex, necessitating a specially outfitted truck.

OBJECTS OF THE INVENTION

It is therefore an object of the present invention to provide an improved mobile apparatus for preparing and loading bulk materials.

Another object is the provision of such a mobile apparatus for preparing and loading bulk materials which overcomes the above-given disadvantages.

Yet another object is to provide this type of apparatus which can be set up easily without the use of a crane even by a construction crew unfamiliar with the equipment.

SUMMARY OF THE INVENTION

These objects are attained according to the instant invention in an apparatus for preparing bulk material and loading same into a truck which comprises an elongated first frame having a lower end and adapted to stand via same on the ground, a horizontal pivot at the lower end of the first frame, and an elongated second frame having a lower end pivoted at the pivot on the lower end of the first frame and an upper end. The frames are relatively pivotally displaceable between a transport position with one of the frames lying substantially within the other frame and a use position with the two frames extending at an angle to each other and the upper end of the second frame spaced above the ground by a distance equal to the loading height of the truck. A rail extends between the ends of the second frame and a bucket is displaceable along the rail between the ends of the second frame by appropriate drive means on the second frame. In addition means is provided at the lower end of the first frame for filling the bucket, when same is at the lower ends, with bulk material.

According to another feature of this invention the apparatus has a filling funnel pivotally mounted on the upper end of the second frame and pivotally displaceable thereon between an inner position lying generally within the second frame and an outer position projecting downwardly from the upper end of the second frame. This funnel is therefore in the inner position for transport of the apparatus, thereby reducing its overall size to a minimum. When in the outer position and in the use position of the apparatus the funnel's lower end is spaced above the ground by a distance sufficient to clear a standard cement truck.

The apparatus of the invention is also provided with a dosing box pivotally mounted on the lower end of the first frame and pivotally displaceable thereon between an inner position lying generally within the first frame and an outer position projecting downward from the lower end of the first frame. This box includes standard weighing and dosing means for the bulk materials, normally cement, aggregate, and even water.

According to another feature of the invention the apparatus has an operator station pivotally mounted on the first frame and pivotally displaceable thereon between an inner position lying generally within the first frame and an outer position projecting out of the first frame.

Thus the apparatus of this invention can be folded up and transported. Making it ready for use is therefore relativly simple, since all the parts remain connected. They need merely be pivoted out and locked in position. This greatly eases the work of setting up and laying down the equipment, and makes assembly mistakes and losing of pieces impossible. In fact a standard construction crew only passingly familiar with the equipment can normally do the job with ease. Furthermore when in the transport position the device is so small it can be carried on a standard semitrailer flatbed.

In accordance with another feature of this invention the first frame has an upper end and the means for filling includes a hopper at this upper end. It is also possible for the filling means to be a drag-bucket type of crane that pulls the bulk materials from a standard sectored heap.

For most compact possible construction, the second frame is formed of an upper beam extending between the respective upper and lower ends and forming the rail and a lower beam extending between the respective upper and lower ends and parallel to and underneath the upper beam in the use position. Thus the bucket can ride right on this structural element of the second frame.

DESCRIPTION OF THE DRAWING

The above and other features and advantages will become more readily apparent from the following, reference being made to the accompanying drawing in which:

FIG. 13 is a side view of a portion of the apparatus of FIG. 12;

FIG. 13A is an end view of the portion of FIG. 13;

FIG. 14 is a side view of another portion of the apparatus of FIG. 12;

FIG. 14A is an end view of the portion of FIG. 14; and

FIG. 15 is a side view of the apparatus of FIG. 12 in the transport position.

SPECIFIC DESCRIPTION

Figures 1, 2:
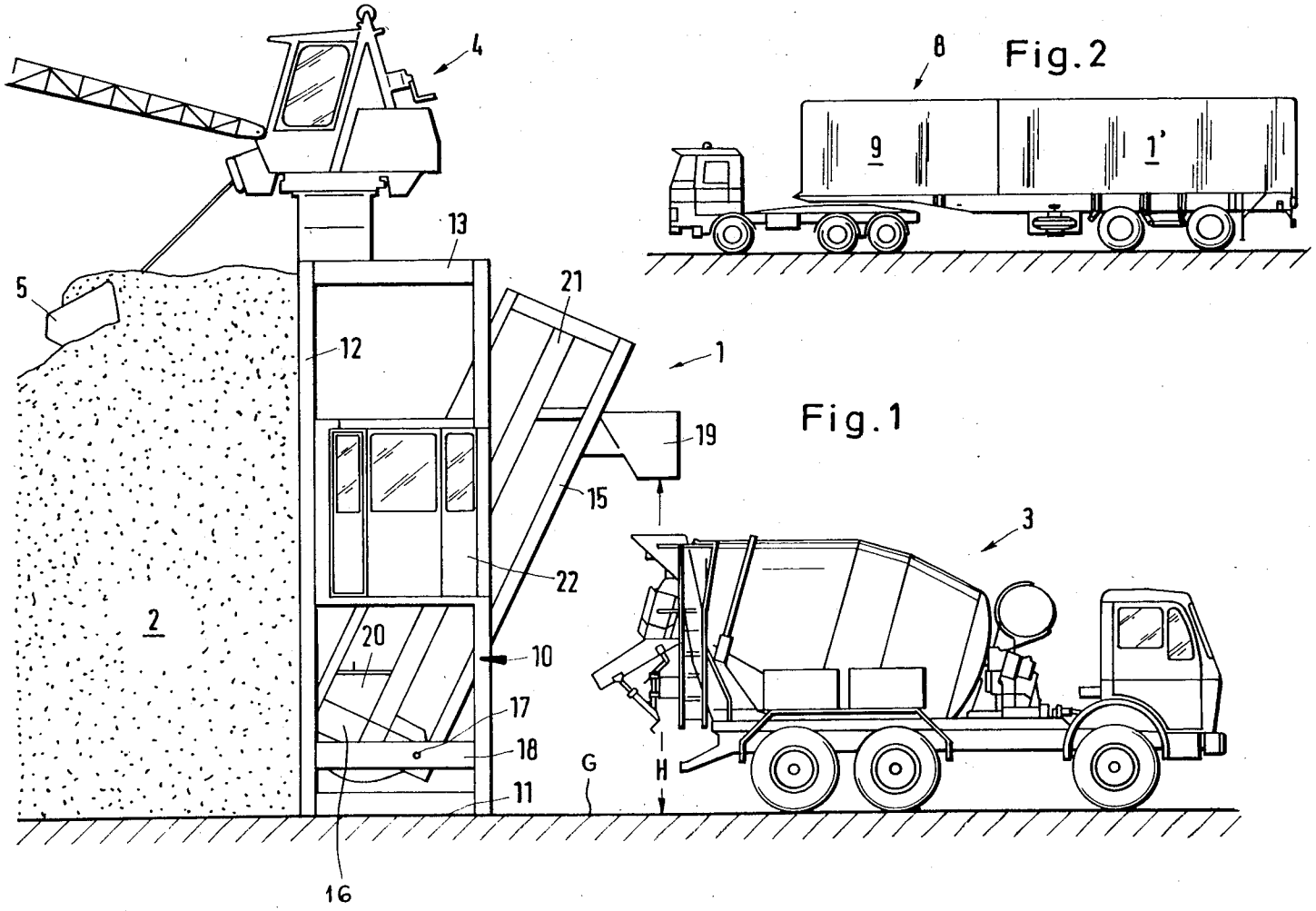
FIG. 1 is a side view of the apparatus according to this invention in the use position.
FIG. 2 is a side view of the apparatus according to this invention in reduced scale and in the transport position.
Figure 11:
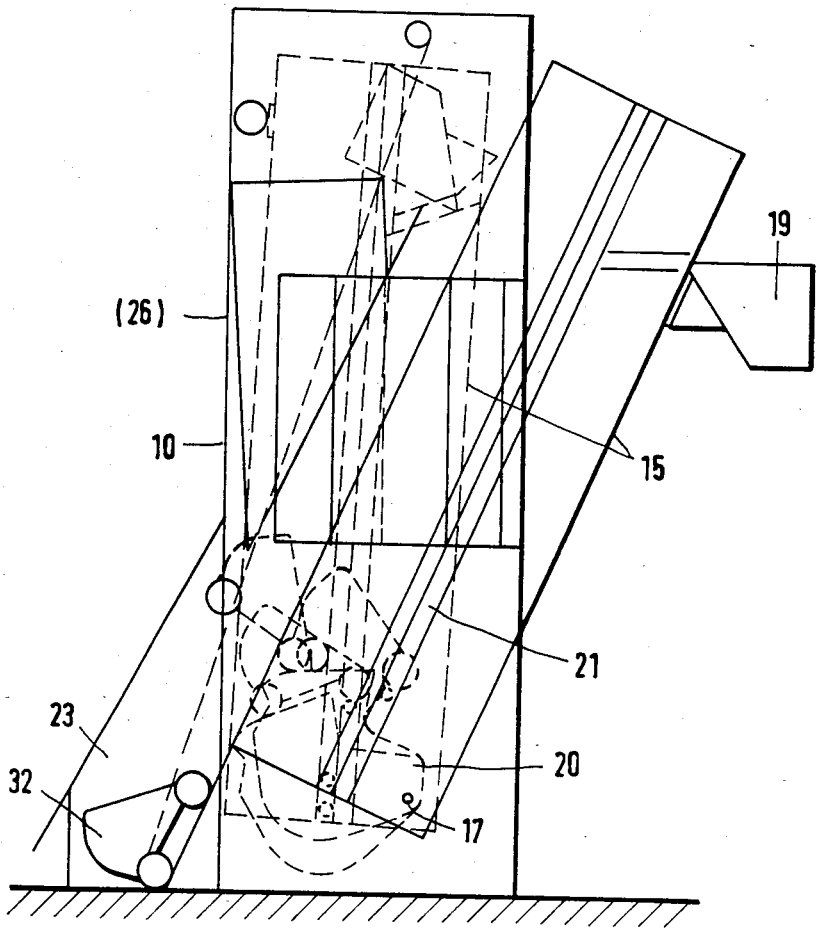
FIG. 11 is a large-scale side view of the set-up apparatus.
Figure 12:
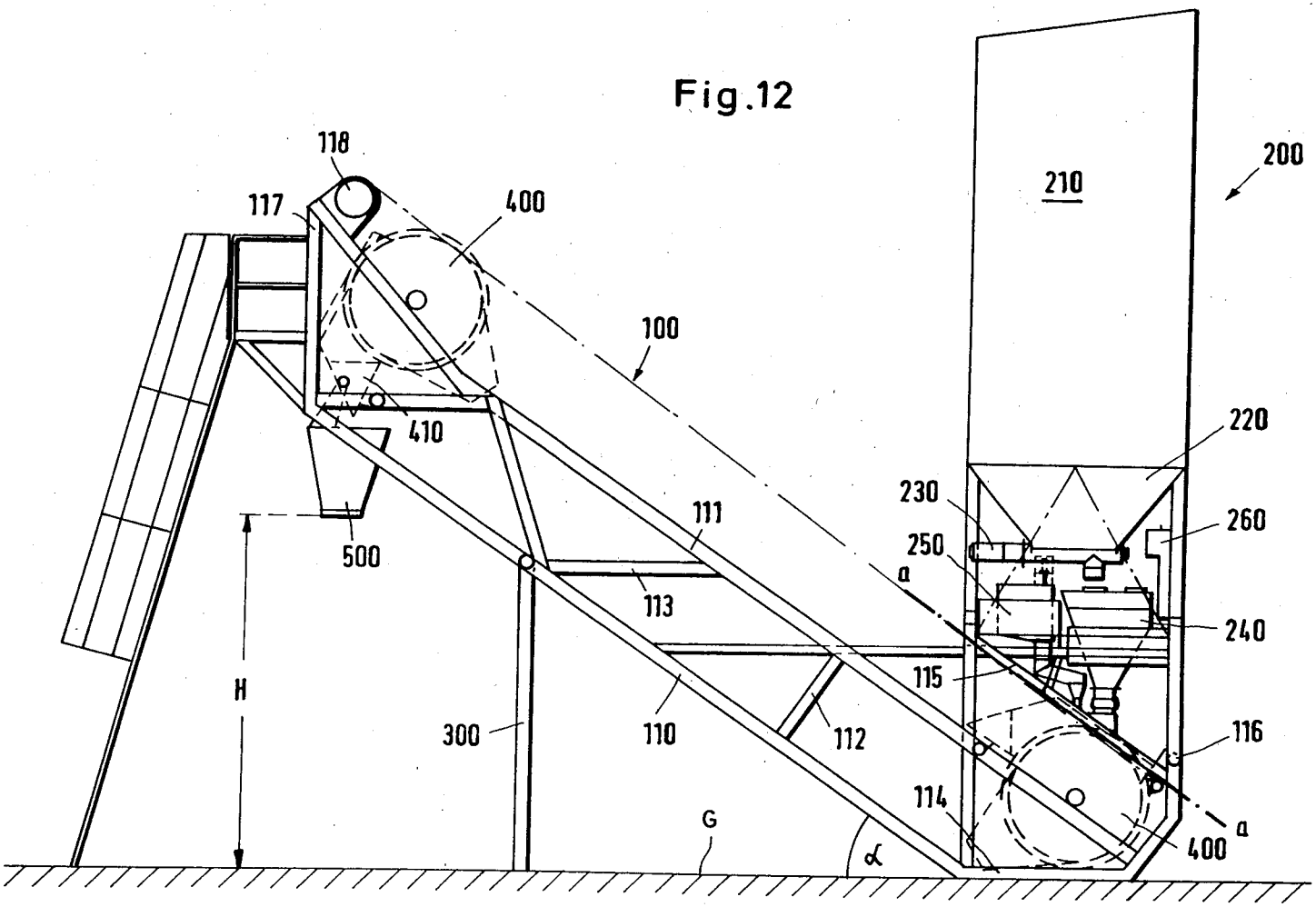
FIG. 12 is a side view of another apparatus according to the invention in the use position.

As seen in FIGS. 1 and 11, an apparatus 1 according to this invention basically comprises a first frame or tower 10 having, in the use position, a lower end 11 adapted to sit on the ground G, an upright side 12 adapted to partially contain a heap 2 of bulk material, and a top end 13 supporting a drag-bucket crane 4 whose bucket 5 can be pulled through the heap 2. Normally the heap 2 is actually a plurality of sector-shaped heaps centered on the apparatus 1 and separated from each other by partitions extending radially therefrom.

A pair of transverse members 18 adjacent the lower end 11 define a horizontal pivot 17 on which is supported the lower end 16 of a second frame 15 which can pivot between a transport position shown in dashed lines in FIG. 11 lying wholly within the tower 10 and a use position tipped out of it. The upper end of this frame 15 pivotally carries a feed funnel 19 that is positioned a distance H above the ground when pivoted out in the use position of the apparatus. This distance H gives enough clearance for a mixer truck 3 to fit under and receive mixed concrete from this funnel 19.

The bucket or scoop 5 delivers the picked-up bulk material to a weighing and dosing apparatus including a conveyor bucket 20 displaceable along longitudinal guide rails 21 of the frame 16. This bucket 20 is provided internally with mixer vanes to blend the cement, water, and aggregate that is loaded into it, although such blending can be left to the truck 3.

More particularly the dosing and weighing arrangement includes a dosing box 23 that can pivot on the tower 10 between an upper and inner position wholly received within this element 10 and a lower and outer position in which it sits next to it on the ground. A wall 26 of the tower 1 defines with this box 23 a closed side that confines the heap 2. The scoop 5 thus delivers the bulk material to a bucket 32 that can ride up in a rail 33 (FIG. 8) in the box 23 then over the bucket 20 to empty thereinto, generally in the manner well known in the art.

It is noted in this context that the bucket 32 can receive mixed bulk material from an arrangement of the type described in commonly owned patent application 406,886 filed Aug. 10, 1982 by H. Pippinger et al, rather than from the active-storage heap 2. In such an arrangement the output bucket or even the conveyor of this device, whose details can be known by reference to this application, can deliver the material directly to the bucket 20.

For transport the device is folded up into the shape 1' shown in FIG. 2 so it can easily be carried on a conventional flatbed truck 8. The space 9*a* next to the folded-up apparatus 1' can be used to hold the crane 4. When folded up the apparatus has a simple parallepipedal shape that can easily fit standard highway clearances.

Figures 3, 4, 4A:
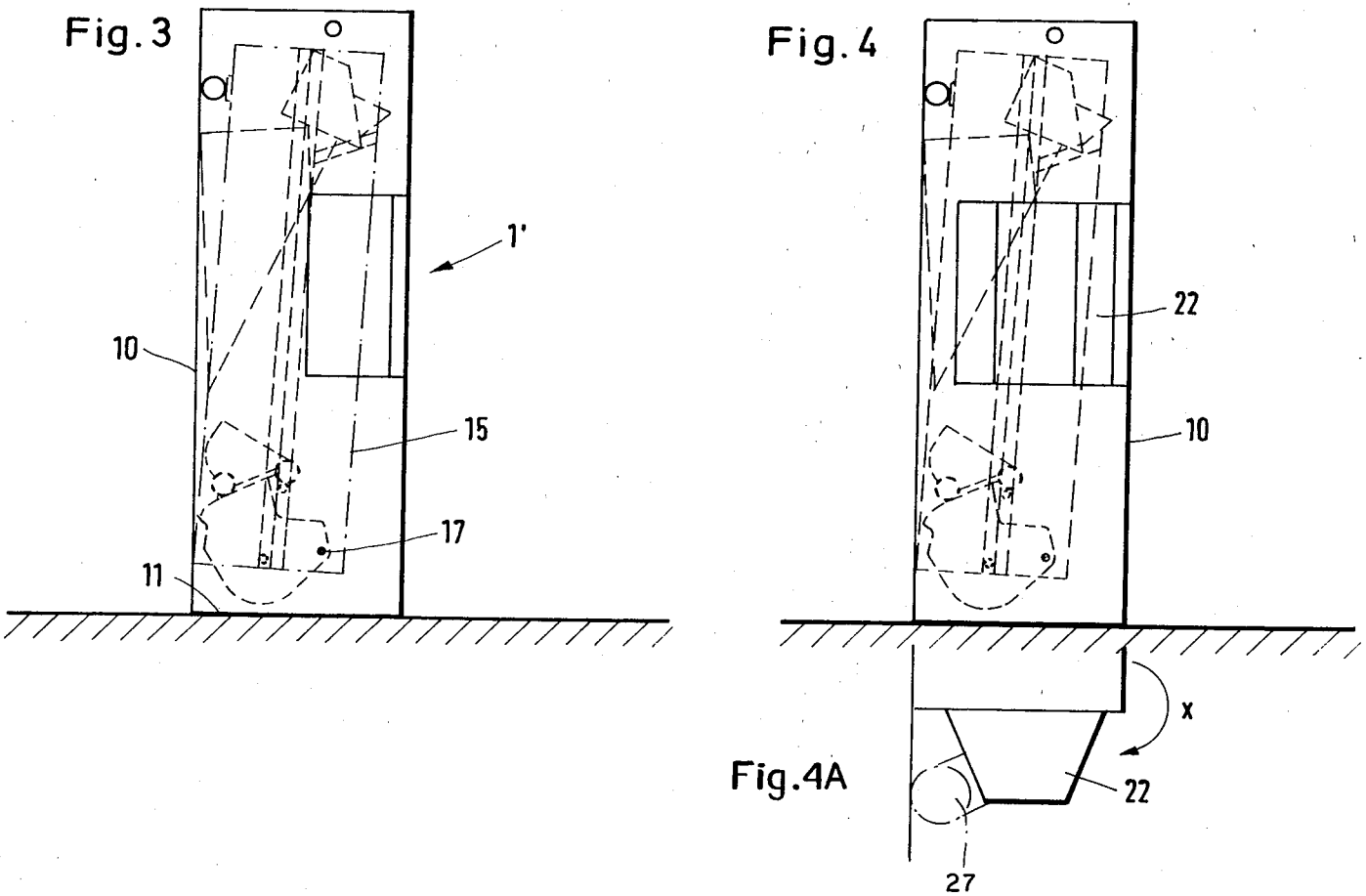
FIG. 3 is a side view of the apparatus in the first stage of being set up.
FIG. 4 is a side view of the apparatus in the second stage of being set up.
FIG. 4A is a top view of a detail of FIG. 4.

For use the folded-up assembly is first stood on its end 11 as shown in FIG. 3, normally on a suitably solid footing. Then as shown in FIGS. 4 and 4A an operator cabin 22 is folded out in direction x and a ladder 27 secured to the outside for access to the cabin 22. When thus folded out the back of the cabin 22 forms a wall of the frame 10.

Figure 5:
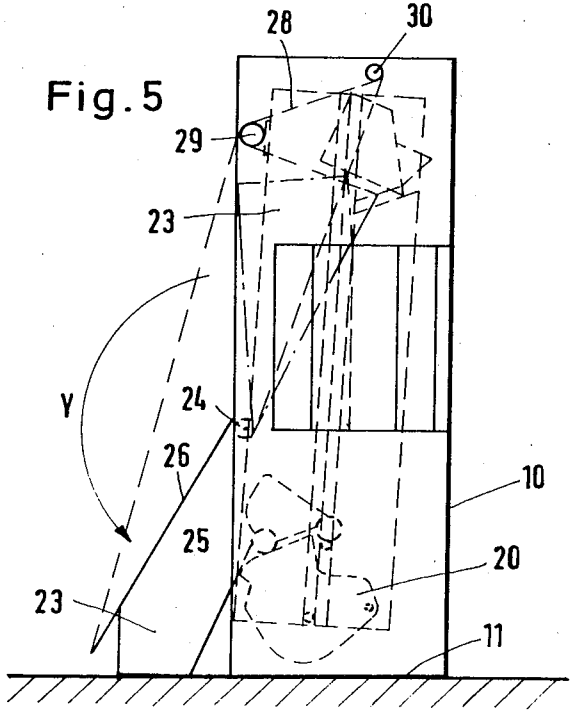

Then as shown in FIG. 5 the dosing box 23 is swung out. This is effected by a winch 30 at the top end of the frame 10 having a cable 28 passing over a roller 29 and connected temporarily to the end of the box 23 opposite its pivot 24, which pivot 24 is to start with below the box 23 and to end with above it. When thus folded out in the direction indicated at y the box 26 forms a dosing compartment underneath the active storage of the heap 2. This box 23 includes a weighing device for gravimetric dosing of the bulk material and a conveyor for emptying the material into the bucket 32.

Figure 6:
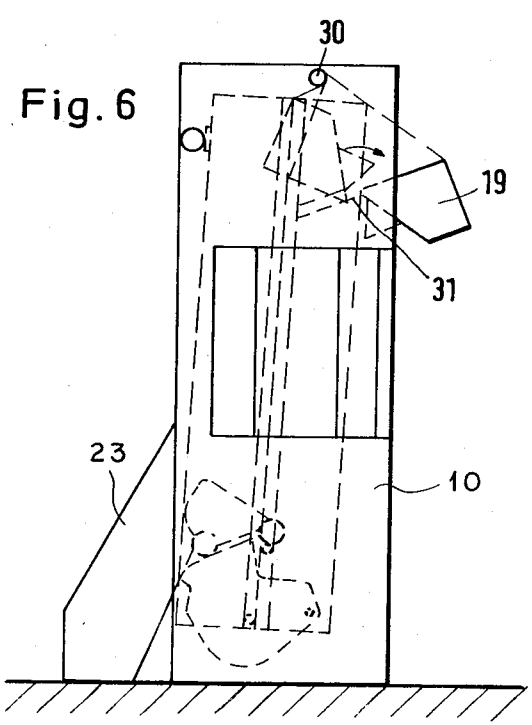
FIGS. 5 through 7 are side views of the apparatus in third through fifth stages of being set up.

The end of the cable 28 is then attached to the funnel 19 as shown in FIG. 6 which the winch 30 then pivots out.

Figure 7:
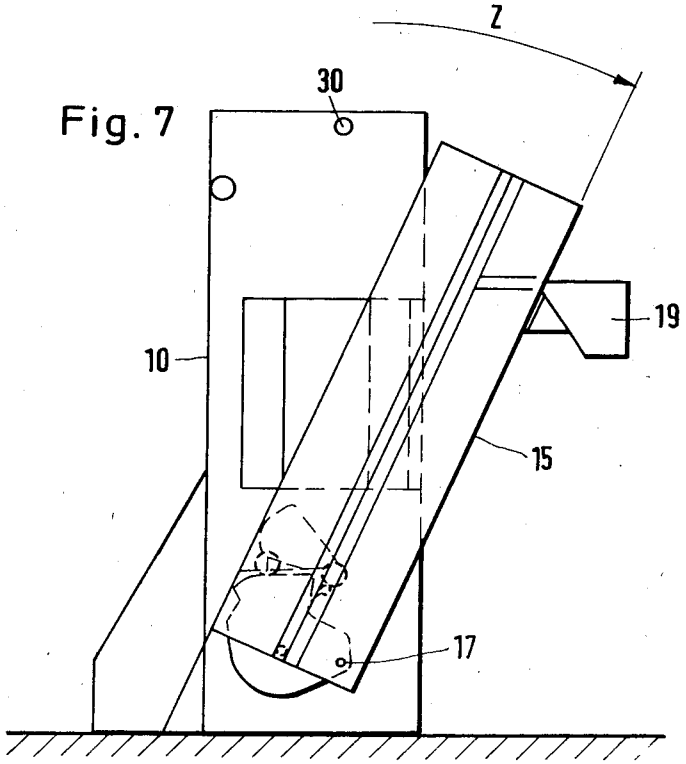

Thereupon, as shown in FIG. 7 the entire inner frame 15 is pivoted out as shown by arrow z. This can be done also by means of the winch 30. Of course once this element 15, or any of the other above-described pivotal parts, is in its use position it is locked in place, normally by easily removable bolts and pins. The device is then ready for use.

Figure 8:
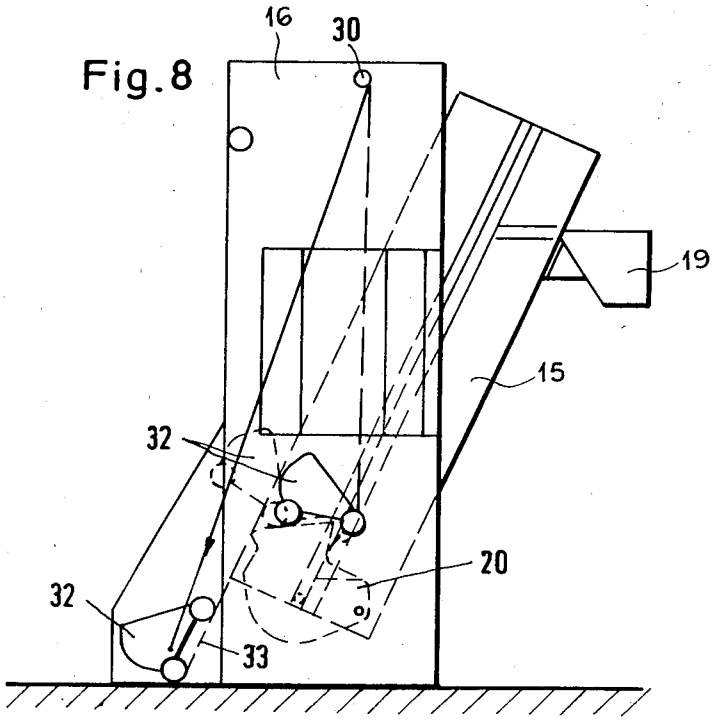
FIGS. 8 through 10 are side view of the apparatus showing its operation.
Figure 10:
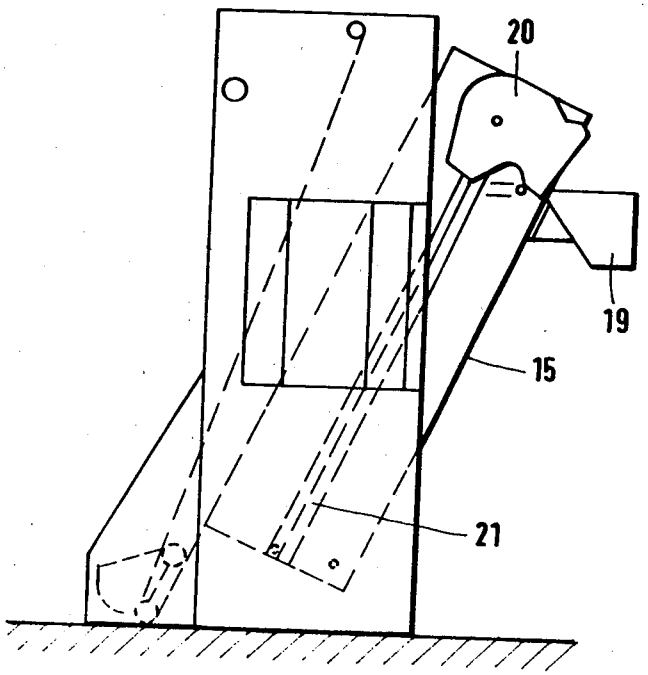
Figure 9:
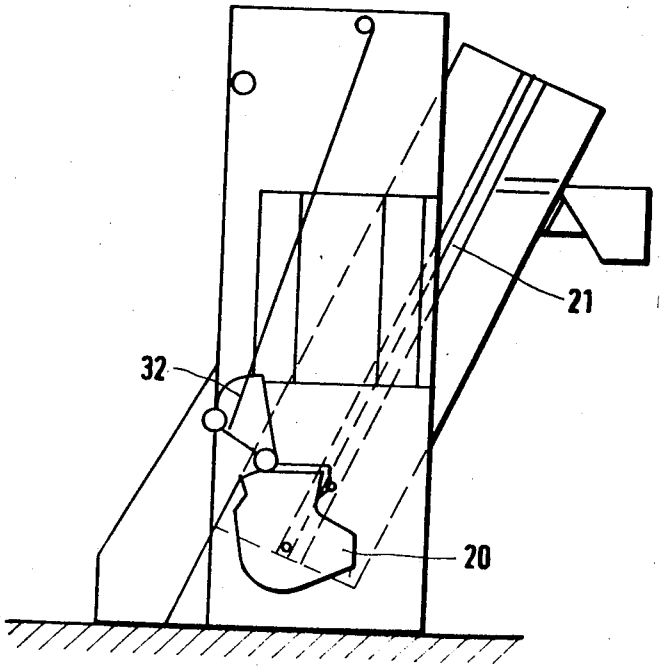

More particularly as shown in FIGS. 8–10 the bucket 32 is removed from atop the bucket 20 and lowered down in its track 33 to the lower dosing position. In this position the bucket 32 lies under the dosing feeds of the active storage of the arrangement where it can receive the variously dosed components.

Then it is lifted back up to dump these contents into the bucket 20 as shown in FIG. 9.

Finally as seen in FIG. 10 the bucket 20 is lifted up along its track 21 and inverts, dumping its contents through the funnel 19 into the truck 3.

FIGS. 12 through 15 show another apparatus according to this invention which works along the same principles as the one described above.

In this arrangement the second frame 100 extends at an angle to the first frame 200 and is supported on the ground G on legs 300 being joined to the first frame 200 at a plane a—a. This frame 100 is formed of a lower beam 110, joined by diagonal and transverse struts 112 and 113 to an upper beam 111 that also serves as the guide rail for a mixer bucket 400. The legs 300 are attached to the lower beam 110.

At its lower end the frame 100 has a diagonal end member 114 that sits flatly on the ground G in the use position so that this member 114 forms an angle alpha equal to around 30° with the member 110. The lower end of the frame 100 is provided above this member 114 with another member 115 that defines the plane a —a and that is connected at a pivot axis 116 to the frame 200.

At its upper end the frame 100 has a vertical member 117 carrying a winch 118 that serves to move the mixer bucket 400 along the rail/beams 111 from the lower end to the upper end of the frame 100. A funnel 500 pivoted underneath a transfer chute 410 of the machine has a lower end positioned in the use position a height H above the ground, like the funnel 19 of FIG. 1. When the mixer bucket 400 moves into its upper position it automatically inverts and dumps its contents through the chute 410 into the funnel 500.

The frame 200 includes a hopper 210 for holding bulk material. At its lower end the hopper has a funnel 220 and a metering unloader 230 that can feed its contents into a weighing device 240. Water is fed to the mixture from an arrangement 250 in the base of the frame 200, and a control panel 260 is provided also at the lower end this frame 200 for operating these units 230, 240, and 250, as well as for operating the winch 118 that moves the mixer bucket 400 between its end positions.

The two frames 100 and 200 are basically square in section as seen in FIGS. 13A and 14A. The frame 200 is of a width b that is slightly smaller than that of the frame 100 so that it can fold inside this element, which is basically of U-section where it receives the frame 200. The legs 300 can fold in or be removable, and the funnel 500 similarly can pivot in. In the transport position as seen in FIG. 15 the mixer bucket 400 is pulled to the top end of the frame 200 to leave the middle of this frame 200 empty so that the hopper 210 and other structure of this frame 200 can fit into it.

To set up the device it is propped up to sit flatly on the members 114, and supported in this position by the legs 300. Then the frame 200 is pivoted out into a vertical position, and the device is ready to use. This operation can be carried out very easily even by a crew that has never done it before and does not require a crane. When set up bent struts are bolted between the frames 100 and 200 to secure them rigidly together.

The hopper or silo 210 can be subdivided internally into several different compartments, or further hoppers or silos can be arranged adjacent it. Such additional compartments or hoppers can all be served by the same weighing device 240.

We claim:

1. An apparatus for preparing bulk material and loading same into a truck, the apparatus comprising:

an elongated and generally parallepipedal first frame having a first end and elongated sides;

a horizontal pivot at the first end of the first frame;

an elongated and generally parallepipedal second frame having a first end pivoted at the pivot on the first end of the first frame and a second end, the frames being relatively pivotally displaceable between a transport position with the second frame horizontal and lying substantially within the first frame which also has said elongated sides horizontal and a use position with the first frame standing via its first end on the ground and with said elongated sides vertical, with the two frames extending at an angle to each other, and with the second end of the second frame spaced horizontally from the first frame above the ground by a distance equal to the loading height of the truck;

a rail extending between the ends of the second frame;

a bucket displaceable along the rail between the ends of the second frame; and means at the first end of the first frame for filling the bucket, when same is at the first end, with bulk material.

2. The bulk-material preparing and loading apparatus defined in claim 1, further comprising a filling funnel pivotally mounted on the second end of the second frame and pivotally displaceable thereon between an inner position lying generally within the second frame and an outer position projecting downward from the second end of the second frame.

3. The bulk-material preparing and loading apparatus defined in claim 1, further comprising a dosing box pivotally mounted on the first end of the first frame and pivotally displaceable thereon between an inner position lying generally within the first frame and an outer position projecting downwardly from the first end of the first frame.

4. The bulk-material preparing and loading apparatus defined in claim 1, further comprising an operator station pivotally mounted on the first frame and pivotally displaceable thereon between an inner position lying generally within the first frame and an outer position projecting out of the first frame.

5. The bulk-material preparing and loading apparatus defined in claim 1 wherein the first frame has an second end, the apparatus further comprising:

a drag-type crane at the second end of the first frame.

6. The bulk-material preparing and loading apparatus defined in claim 1 wherein the second frame is formed of an upper beam extending between the respective second and first ends and forming the rail and a lower beam extending between the respective second and first ends and parallel to and underneath the upper beam in the use position.

* * * * *